US006981815B1

(12) United States Patent
Jabri

(10) Patent No.: US 6,981,815 B1
(45) Date of Patent: Jan. 3, 2006

(54) DECORATIVE PAINT ROLLER AND METHOD TO USE

(76) Inventor: Mohammd Y. Jabri, 215 Bull Run Dr., Hopewell, VA (US) 23860

( * ) Notice: Subject to any disclaimer, the term of this patent is extended or adjusted under 35 U.S.C. 154(b) by 0 days.

(21) Appl. No.: 11/130,590

(22) Filed: May 17, 2005

(51) Int. Cl.
*B43M 11/02* (2006.01)

(52) U.S. Cl. ..... 401/218; 401/208; 401/220

(58) Field of Classification Search ..... 401/197, 401/207, 208, 218–220; 101/330, 350.1; 107/330
See application file for complete search history.

(56) References Cited

U.S. PATENT DOCUMENTS 2,485,428 A 10/1949 Bleier et al.
2,678,002 A 5/1954 Roell, Jr. et al.
2,833,073 A 5/1958 Doggett
3,148,402 A * 9/1964 Garabon ..... 401/218
3,905,295 A 9/1975 Bielesch et al.
D248,416 S 7/1978 Lupkes
4,257,140 A 3/1981 Downing
4,630,952 A 12/1986 Elbaum
5,615,444 A * 4/1997 Reye ..... 401/218
5,857,795 A * 1/1999 Liou ..... 401/218

* cited by examiner

*Primary Examiner*—Tuan Nguyen
(74) *Attorney, Agent, or Firm*—Lawrence J. Gibney

(57) ABSTRACT

This device will allow decorative painting to be accomplished in an easy task using one simple device. It will produce a uniform application pattern so that there is consistency of the result.

7 Claims, 3 Drawing Sheets

DECORATIVE PAINT ROLLER AND METHOD TO USE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

Painting a design on a surface can be done in variety of ways but perhaps the most efficient method is to have a paint roller which will provide that pattern for the homeowner or business owner. The current device achieves that particular result.

B. Prior Art

There are other relevant prior art references that involve painting and specifically paint rolling. A representative example of a paint applicator is Roell, U.S. Pat. No. 2,678,022 and another is Lupkes U.S. Pat. No. D 248,416. Neither one of these devices have multiple rollers like the current device. Another very similar prior art patent is Elbaum, U.S. Pat. No. 4,630,952. This has a series of multiple rollers similar to the current device. In Elbaum two rollers are used, however, in this case three rollers are used with a painting pattern, which can be changed or permanently attached, if desired. Elbaum does not anticipate painting a design.

Another device involving a roller, is Downing, U.S. Pat. No. 4,257,140 which is a basic roller sleeve to fit over the roller head.

BRIEF SUMMARY OF THE INVENTION

This is a device, which is comprised of a paint reservoir and a plurality of rollers through which paint is transferred from the paint reservoir to the outermost paint roller.

The outer most paint roller contains a decorative pattern. The decorative application roller may be changed depending on the specific needs or tastes of the customer. This capability would provide the homeowner with the ability to custom design a pattern on his or her wall. Additionally it is contemplated that the individual pieces, which determine the design on the outermost roller may be changed on the decorative application roller itself. This may be accomplished by using replacement pieces, which can slide into grooves or an adhesive on the decorative application roller.

The two intermediate rollers, which are in contact with each other will be utilized to ensure that paint is applied evenly to the decorative application roller and produce a uniform application of the paint on the wall.

The paint is applied to the wall by pouring paint into the paint reservoir and using the handle which has been provided for this particular device. The decorative application roller or the roller with the design or pattern is placed against the wall. Intermediate rollers are placed between the decorative application roller and the roller in the paint reservoir.

As the decorative application roller is rotated, the intermediate rollers, and the roller in the paint reservoir also rotate. This allows the paint to eventually be transferred from the paint reservoir roller to the decorative application roller.

The decorative application roller can be changed depending on the tastes of the homeowner. A brace on both sides of the rollers maintains the position of the rollers on the device to insure an even application of paint.

DETAILED DESCRIPTION OF THE EMBODIMENTS

Figure 1:
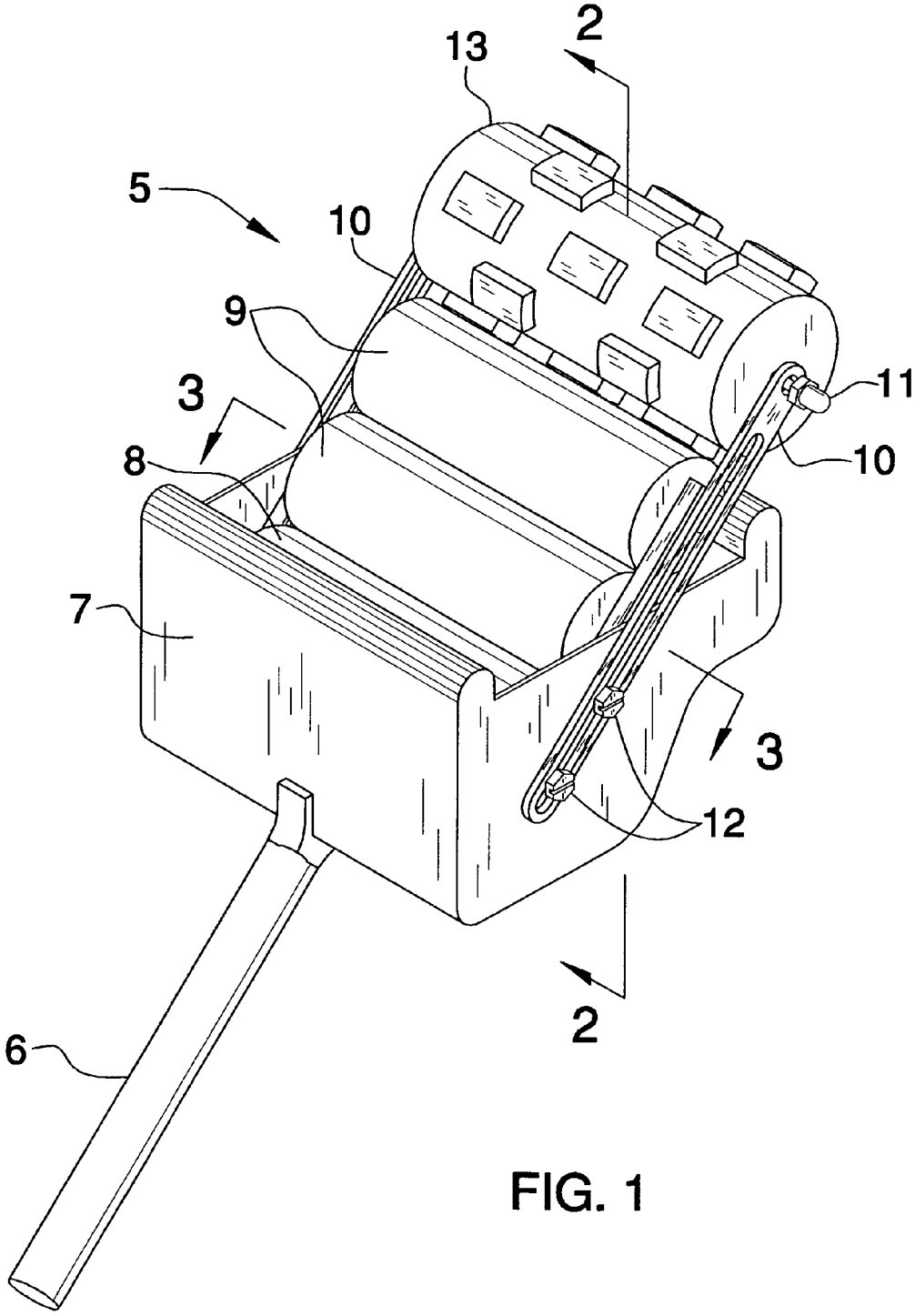
FIG. 1 is a perspective view of the device.

The device 5 is a paint roller, which allows the individual to add a decorative touch to any wall or surface. FIG. 1.

Figure 2:
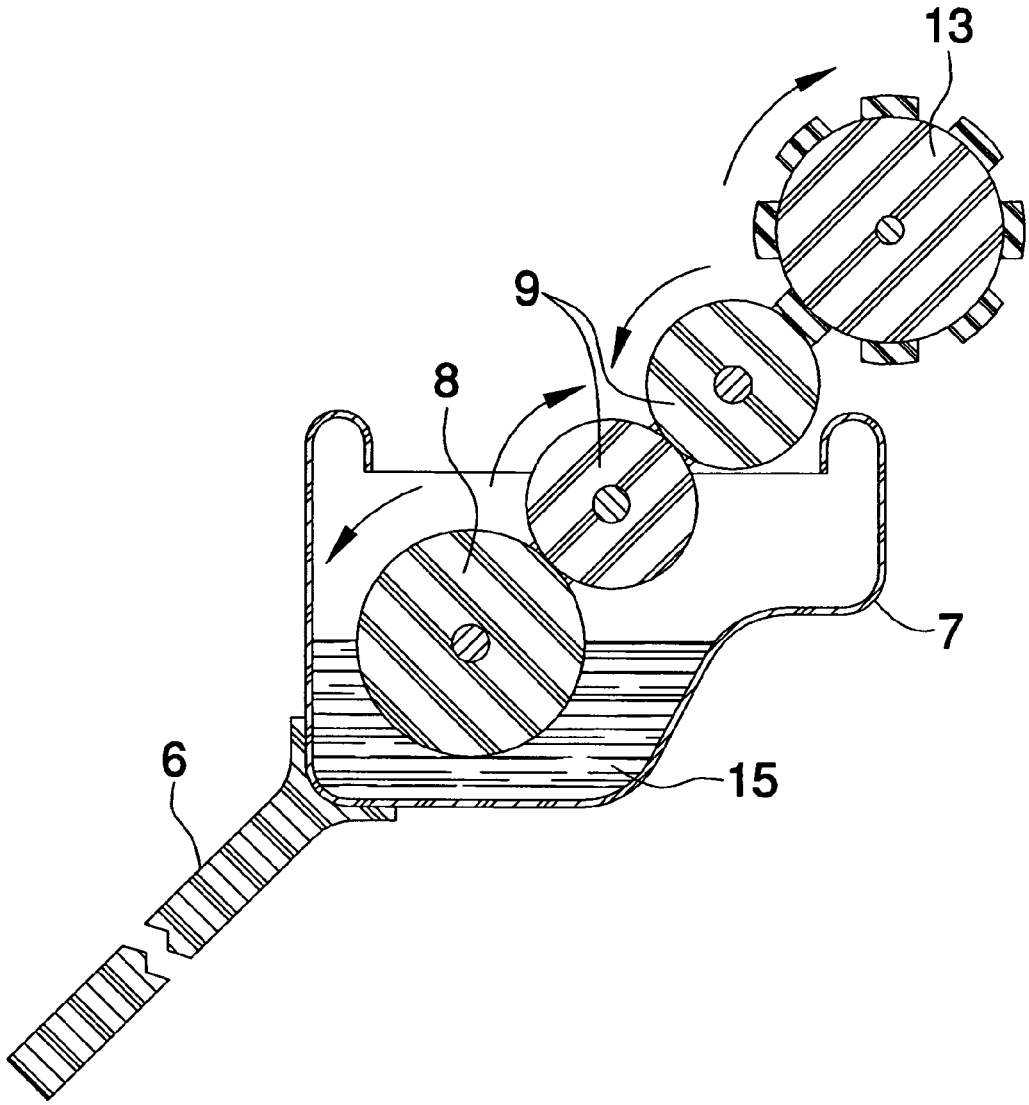
FIG. 2 is a cross sectional view of the device according to line 2—2 on FIG. 1.
Figure 4:
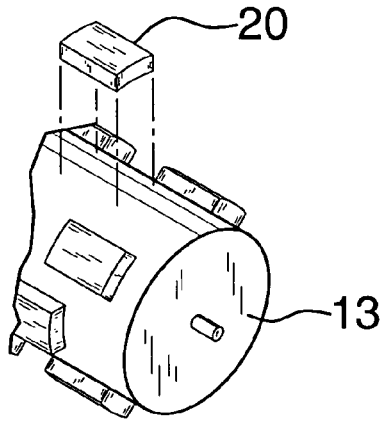
FIG. 4 is a partial fragmented view of the alternative embodiment of the decorative application roller.

A paint reservoir 7 is partially filled with paint. A plurality of rollers, including a paint reservoir roller 8 and two intermediate rollers 9, are used to apply paint to a decorative application roller 13. FIG. 2 The decorative application roller 13, which is the outer most roller contains a plurality of pieces, which are slightly raised and contain the imprint of a desired design. The design pieces 20 may be affixed to the paint roller or be detachable. FIG. 4.

The outer surface of all the rollers touch so that when the decorative paint roller 13 rotates all the other rollers 8, 9 rotate according to the direction indicated on FIG. 2. The paint 15 is transferred by the rotation of the roller 8, 9 in contact with each other and eventually transferred to the paint application roller 13.

A handle 6 is connected to the paint reservoir for ease of application. The handle may be molded or attached to the paint reservoir using a means of attachment. The paint that is in the reservoir partially surrounds the paint reservoir roller 8. One intermediate roller 9 contacts the surface of the paint reservoir roller 8. As the decorative application roller 13 rotates it causes rotation of all other rollers. As the paint reservoir roller 8 rotates, paint is transferred to the other rollers and eventually the surface that is to be painted.

Figure 3:
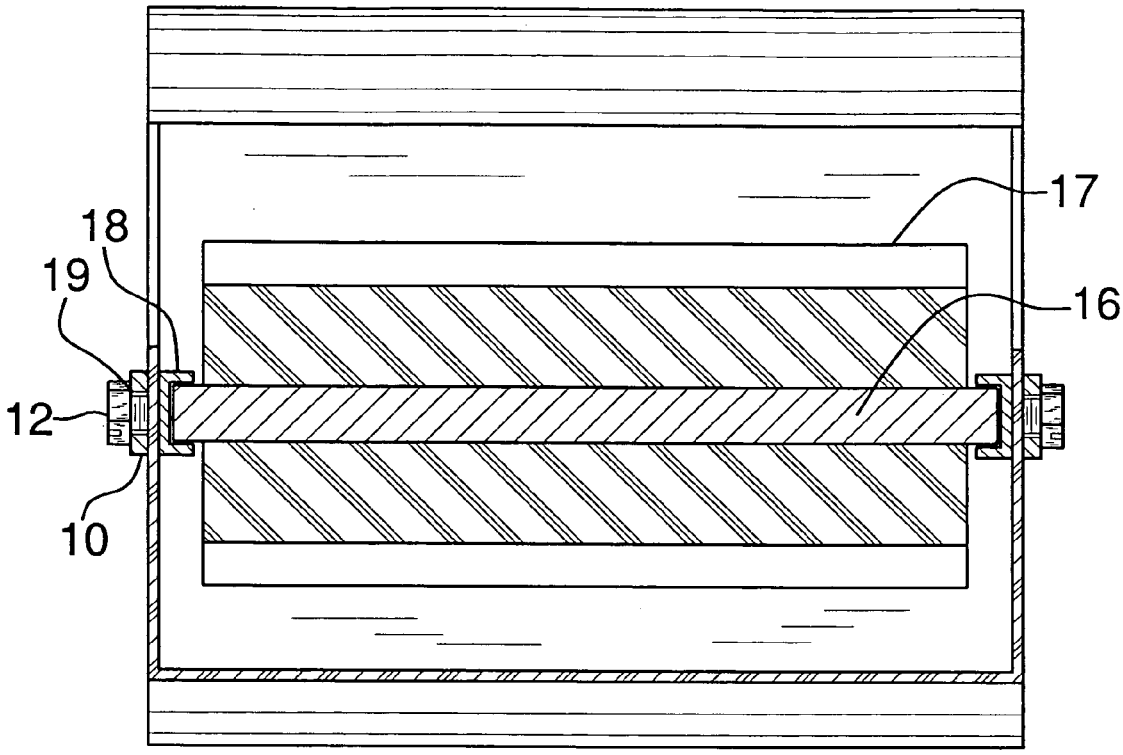
FIG. 3 is a cross sectional view of the device according to line 3—3 on FIG. 1.

Two braces 10 and a spindle guide 18 insure proper alignment of the intermediate rollers 9, which extend from the paint reservoir 7 to the decorative application roller 13. FIGS. 1, 3 Each of the braces 10 has a hollow portion 19 through which the means of attachment 12 such as a screw is threaded and insures that the braces are secured to the outside of the paint reservoir 7. FIGS. 1, 3.

Two braces 10 on the sides of the paint reservoir 7 secure the decorative application roller 13 as well as the two intermediate rollers 9 and paint reservoir roller to the device. FIG. 1 A spindle guide 18 maintains proper alignment of the rollers and allow the rollers 8, 9, 13 to be connected to each other and allow the rollers to be changed. FIG. 3 The guides 18 are secured to the device in some fashion such as through the use of a screw 12 or bolt. FIGS. 1, 3 The shaft 16 of each of the rollers 9 extends slightly beyond the surface of the roller to which paint is applied and fits within the opening of the spindle guide 18. FIG. 3.

The spindle guide 18, has a flat back surface and two flat side surfaces and is of a predetermined shape to accommodate the shaft 16 of the roller. FIG. 3 The spindle guide 18 maintains proper alignment of the rollers during the painting operation.

The decorative application roller 13 is secured to one end of the brace 10 by use of a securement means such as an acorn nut 11. Other securement means may include a wing nut, which is placed on the respective threaded ends of the decorative application roller 13. The two ends of the decorative application roller 13 are threaded to accommodate the means to secure. This securement means allow the decorative application roller 13 to be removed from the device 5. A shaft 16, which runs through the center of each of the rollers and protrudes on the ends allows the rollers to be secured to the device. The decorative application roller 13 is the only roller with threaded ends.

FIG. 4 is a partial representation of the decorative application roller 13. The decorative application roller 13 can be used to apply different print designs through a series of raised design pieces 20, which contain the desired design. FIG. 4 The different shapes and sizes of the print design pieces 20 may be attached to the surface of the decorative application roller 13 by using double sided tape or grooves in the decorative application roller 13 and corresponding slots on the print mechanism. Other desired means of attachment of the print mechanism may also be used. It is also contemplated that the print design pieces 20 may be permanently attached to the decorative application roller 13 and the entire roller may be changed.

As the decorative application roller 13 moves across the surface it forces the outer surface 17 of the two intermediate rollers 9 to move in opposite directions and also forces the reservoir roller 8 to absorb some of the paint. The reservoir roller 8 transfers the paint to the intermediate rollers 9 and then to the print design pieces 20 on the decorative paint roller 13. The print design pieces 20 on the decorative reservoir roller 13 are slightly raised and are of predetermined dimensions to achieve the stated purpose. FIGS. 1, 2, 4.

The handle 6 may be attached to the bottom surface of the paint reservoir 7 through the use of a variety of fixably attaching means. The handle 6 may also be molded to the paint reservoir as a single piece.

What is claimed is:

1. A device for applying a decorative paint pattern which is comprised of:

a. a paint reservoir;

wherein a predetermined quantity of paint is placed in the paint reservoir;

b. a paint reservoir roller;

c. intermediate rollers;

d. a decorative application roller;

wherein the outer surface of the paint reservoir roller, intermediate rollers and decorative application roller are in contact with each other and are allowed to rotate;

e. a brace;

wherein the brace is used to secure all rollers to the device and the paint reservoir;

wherein a spindle guide is placed within the brace to maintain the proper alignment of the intermediate rollers;

f. a plurality of print design pieces are placed on the surfaces of the decorative application roller;

g. a means to secure the decorative application roller;

h. means to attach the print design pieces.

2. The means to secure the decorative application roller as described in claim 1 is an acorn nut.

3. The means to secure the decorative application roller as described in claim 1 is a wing nut.

4. The means to secure the decorative application roller as described in claim 1 is a nut and bolt.

5. The means of attachment for the print design pieces as described in claim 1 is double sided tape.

6. The means of attachment for the print design pieces as described in claim 1 is a slot in the decorative application roller with a corresponding groove on the print design piece.

7. The print design pieces as described in claim 1 are attached permanently to the decorative application roller.

* * * * *